US005839569A

United States Patent [19]

Spindler et al.

[11] Patent Number: 5,839,569

[45] Date of Patent: Nov. 24, 1998

[54] METHOD OF CONVEYING TUBES ON A TEXTILE MACHINE AND DEVICE FOR CARRYING OUT THE METHOD

[75] Inventors: Zdenek Spindler, B. Nemcove; Zbynek Vencl, Mazankova; Vojtech Novotny, Dukelska, all of Czech Rep.

[73] Assignee: Rieter Elitex A.S. Usti nad Orlici, Czech Rep.

[21] Appl. No.: 518,429

[22] Filed: Aug. 23, 1995

[30] Foreign Application Priority Data

Aug. 24, 1994 [CZ] Czech Rep. ..... 2055-94

[51] Int. Cl.[6] ..... B65G 15/10

[52] U.S. Cl. ..... 198/817; 198/841

[58] Field of Search ..... 198/817, 841, 198/389

[56] References Cited

U.S. PATENT DOCUMENTS

| | | | |
|---|---|---|---|
| 1,401,372 | 12/1921 | Sutherland | 198/817 |
| 2,102,248 | 12/1937 | Yeakel | 198/817 |
| 2,962,152 | 11/1960 | Lathrop | 198/841 |
| 3,356,205 | 12/1967 | McLeod | 198/817 |
| 3,498,443 | 3/1970 | Weber | 198/389 |
| 3,823,815 | 7/1974 | Bretten et al. | 198/389 |
| 4,248,561 | 2/1981 | Graves | 198/817 |
| 4,498,273 | 2/1985 | Colamussi | 198/389 |
| 4,550,820 | 11/1985 | Bishop | 198/389 |

FOREIGN PATENT DOCUMENTS

| | | | |
|---|---|---|---|
| 261887 | 3/1962 | Australia | 198/389 |
| 246547 | 12/1987 | Czech Rep. . | |
| 261150 | 5/1989 | Czech Rep. . | |
| 268301 | 7/1990 | Czech Rep. . | |
| 1091207 | 4/1964 | United Kingdom | 198/389 |

*Primary Examiner*—William E. Terrell
*Assistant Examiner*—Khoi H. Tran
*Attorney, Agent, or Firm*—Dority & Manning

[57] ABSTRACT

A method and device are provided for conveying tubes (2) on a textile machine in which cylindrical (21) or conical (22) tubes are conveyed, one at a time, by means of a conveyer (6) provided along a line of operating units from a tube container (5) to an attending device (4). The tube (2), while being conveyed, leans on the circumference only on the moving parts of the conveyer (6) in at least two straight sections parallel with the direction of motion of the conveyer (6). The conveyer for carrying out this method comprises two endless belts (61) arranged next to each other along the machine length in such a manner that their mutual distance is along the machine length constant and inferior to the average diameter of the tube to be conveyed (21, 22).

6 Claims, 4 Drawing Sheets

METHOD OF CONVEYING TUBES ON A TEXTILE MACHINE AND DEVICE FOR CARRYING OUT THE METHOD

BACKGROUND OF THE INVENTION

The present inventions relates to a method of conveying tubes on a textile machine in which cylindrical or conical tubes are conveyed, one at a time, by means of a conveyer provided along a line of operating units from a tube container to an attending device of the machine. The invention also relates to a device for carrying out the method comprising a tube conveyer arranged along a line of operating units of a textile machine.

In automatic textile machines in which yarn or thread being produced is wound on a bobbin at each operating unit of the machine, the bobbin, when (fully) wound, must be removed from the operating unit and replaced by an empty tube. This replacement of a (fully) wound bobbin by an empty tube can be made manually or by means of an automatic attending device that, however, must be equipped with an empty tube ready to be inserted at the moment of replacement.

There is known a number of methods for conveying tubes to the operating units of a textile machine. In one of them, the attending device carries a number of tubes along with it. Its drawback consists in the necessity to replenish the inevitably limited total number of tubes in the attending device thus cutting down the productivity of the attending device; besides, the tube can fall out of the container of the attending device while the latter is moving from an operating unit to a next one.

Also known are systems of tube conveying, disclosed for instance in the CS AO 246 547 (inventor's certificate), in which one tube, currently replenished, is seated at each operating unit. The conveying is provided for, for instance, by means of chain or trough conveyers. The chief drawback consists in the complicated state of the conveying and depositing means container a large number of repeating components and having high trouble incidence.

The drawbacks of the above tube conveying systems have been eliminated by a device for distributing and delivering separate tubes, one at a time, to the winding units of a textile machine. The tubes are seated in the container separately on a moving device, and more specifically, on a conveyer equipped with pins on which the tubes are seated without being in mutual contact. From the container, the tubes are doffed with a doffing device and transferred on the conveyer by which they are in the axial position, one at a time, transferred to gripping means adapted to stop the tube on the conveyer and to take it from the conveyer.

The drawback of this solution consists in particular in that the conveyer contains stationary passive members serving to keep the tube on the conveyer in its axial position. These stationary passive members are raised over the active element of the conveyer (made as a thin belt), and they are able to keep the cylindrical tube in the above mentioned axial position during the conveying motion that is, however, braked by the passive members. The passive members must be attached alongside the machines, and the connecting points pose the risk of deviating the tube, while conveyed, from its correct conveying position and make it fall out of the conveyer, especially at high conveying speeds of the tube. If such a conveyer is used for conveying conical tubes, the position of the tube on the active element of the conveyer, while being conveyed to a winding unit, cannot be defined unambiguously. The conical tube rests on the active element with a part of its conical side, and its axis is directed obliquely into the active element of the conveyer. The great diameter of the conical tube is led by the stationary passive members while its small diameter passes between said passive members with a large clearance so that the axis of the conical tube is deflected from the direction of motion of the active element of the conveyer to the stationary passive members, oscillates between them, and the tube risks falling out of the conveyer and even causing a defect of the machine.

Similar disadvantages are also found in the device for conveying tubes disclosed in the CS AO 261 150, which provides an improvement over the preceding device by positioning the tube stopped by means of the device on the conveyer to the position in which the projection of the tube axis to the active element of the conveyer is parallel with the direction of motion of this element. However, this modification complicates the device and does not eliminate the risk of the conical tube falling out due to the oscillation of its narrow flange between the stationary passive members of the conveyer.

The drawbacks of these solutions are further partly eliminated by the device for conveying tubes disclosed in CS AO 268 301 in which the tube is conveyed also by a flat conveyer belt serving as the active element of the conveyer and positioned obliquely. During its transport, the tube leans on a passive member. Even here, the position of the tube on the conveyer is not stable and the tube falls out frequently, especially because the passive member, due to its being attached, is not ideally straight throughout the machine length.

OBJECTS AND SUMMARY OF THE INVENTION

The above drawbacks of the state of art are eliminated by the present invention, a principal object of which is to provide a method of conveying tubes on a textile machine in which cylindrical or conical tubes are conveyed, one at a time, by means of a conveyer provided along a line of operating units from a tube container to an attending device of the machine. Additional objects and advantages of the invention will be set forth in part in the following description, or may be obvious from the description, or may be learned through practice of the invention.

According to the principle of the invention, the tube, while being conveyed, leans on the circumference only on the moving parts of the conveyer in at least two straight sections parallel with the direction of motion of the conveyer thus obtaining a smooth movement of the tube remaining throughout its transport on the conveyer in one and the same position.

The device for carrying out the method includes a conveyer containing two endless belts arranged next to each other along the machine length in such a manner that their mutual distance is along the machine length constant and less than the average diameter of the tube to be conveyed.

The device according to the invention is a simple and reliable conveyer for both the cylindrical and conical tubes in which the tubes rest only on the active elements of the conveyer which they touch in two straight sections. The position on the conveyer of both the cylindrical and conical tubes is equally stable thus permitting transportation of the tube at maximum speed without the risk of it oscillating and falling out.

The endless belts preferably can have a circular or oval cross section.

Preferably, the conveyer is fitted with at least one support seated under the upper active strand of the endless belts. The support makes the endless belt run smoother and is preferably provided at least along the whole length of the active strand of the endless belts.

The smoothest conveyer run can be obtained with a support made as a trough with a shaped bottom in which the endless belts of the upper active strand are led through the lower part in recesses provided in the bottom of the support thus ensuring their smooth running and constant distance while at the same time preventing the endless belts from sagging.

The distance between the endless belts can be adjustable.

In another embodiment, the conveyer can contain one wide conveyer belt whose raised edges rise above the central part of the belt and the distance of the raised edges is less than the average diameter of the tube to be conveyed.

The wide conveyer belt can consist of an indented belt whose teeth are directed outwards and their raised edges rise above the central part.

BRIEF DESCRIPTION OF THE DRAWINGS

Examples of embodiments of the device according to the invention are schematically shown in the accompanying drawings in which.

DETAILED DESCRIPTION OF THE PREFERRED EMBODIMENTS

Figure 1:
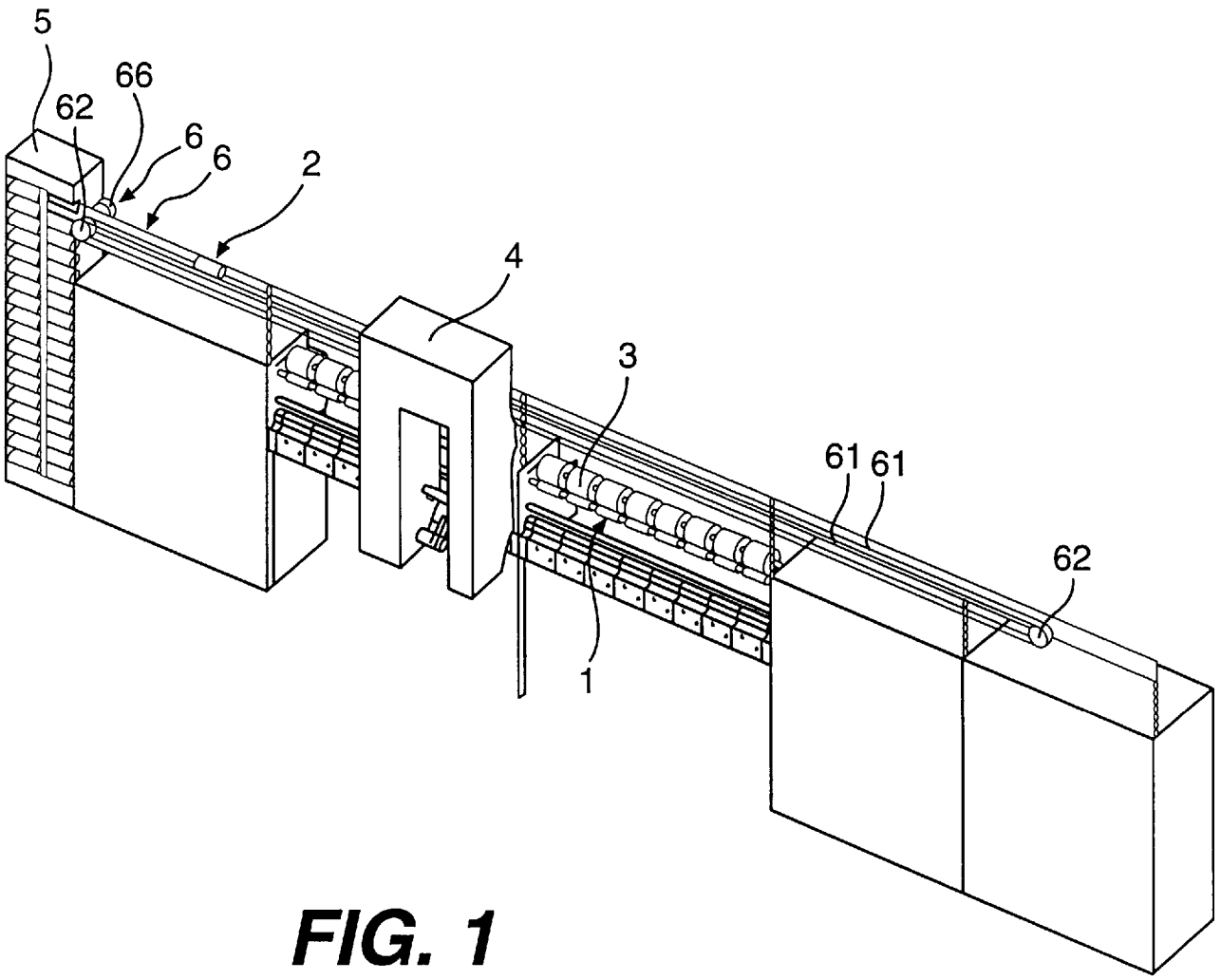
FIG. 1 is a view of a textile machine.
Figure 2:
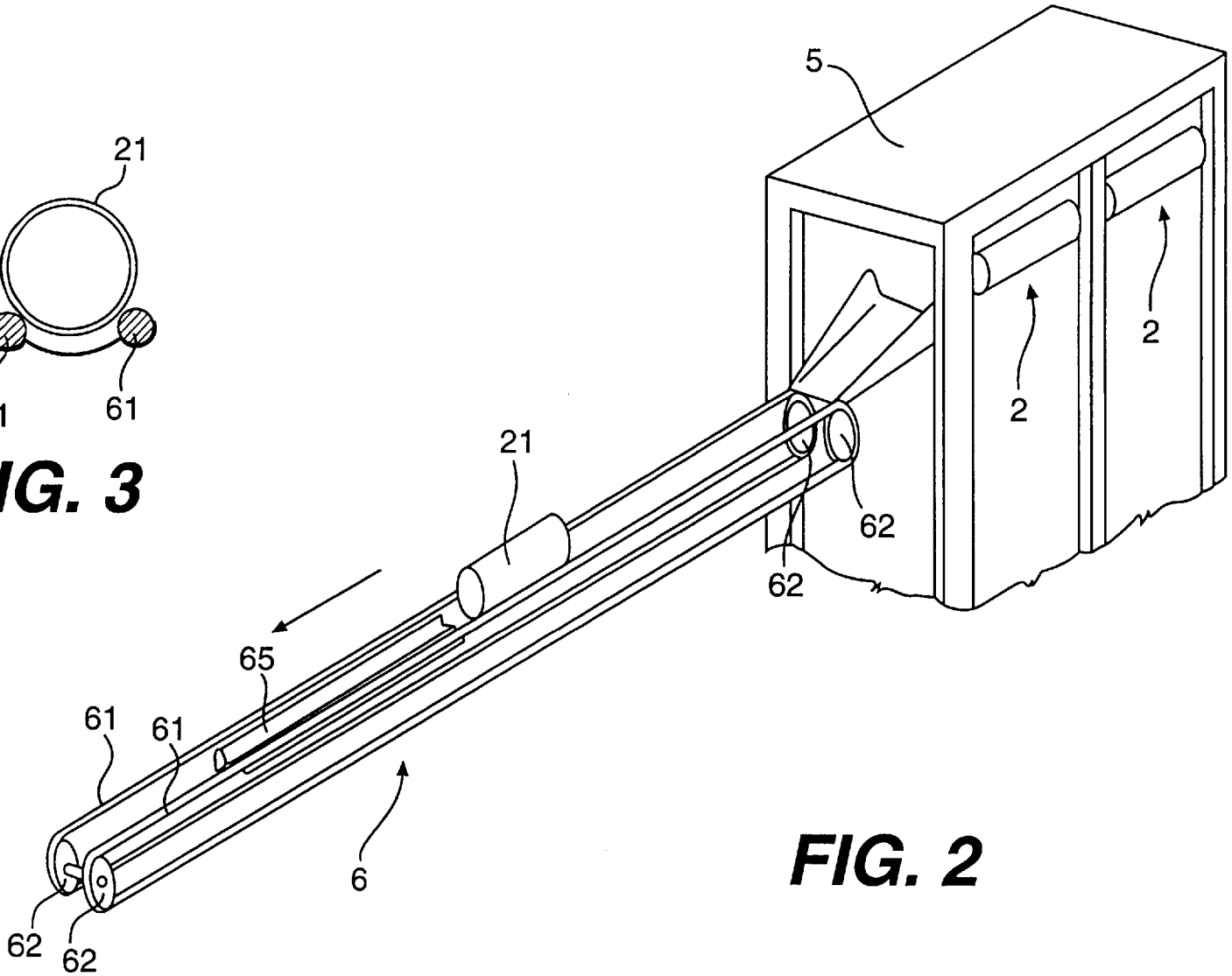
FIG. 2 is a view of a tube conveyer consisting of two endless belts while conveying a cylindrical tube.

Reference will now be made in detail to the presently preferred embodiments of the invention, one or more examples of which are shown in the drawings.

The textile machine, for instance an open-end spinning machine, contains a plurality of operating units arranged next to each other. Each operating unit carries at its end a winding device 1 in which yarn or thread is wound on a tube 2 thus producing a bobbin 3. The textile machine is equipped with an automatic attending device 4 adapted to move along the operating units of the machine. At one end of the machine there is provided a container 5 of tubes 2 spreading at least along the whole length of the operating units of the machine. The container 5 of the tubes 2 is fitted with a well-known and not represented mechanism for distributing the tubes 2 separately from the container 5 to a conveyer 6 conveying each tube 2 separately to the attending device 4.

In the example of embodiment shown in FIGS. 1 to 7, the conveyer 6 consists of two endless belts 61 seated jointly on at least two pulleys 62, at least one of which is driving pulley coupled with a drive mechanism 66.

Figure 3:
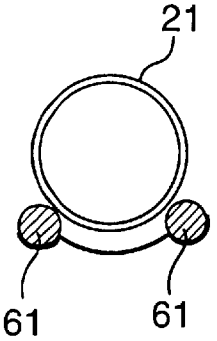
FIG. 3 is a cross section view of the conveyer with the tube shown in FIG. 2.
Figure 4:
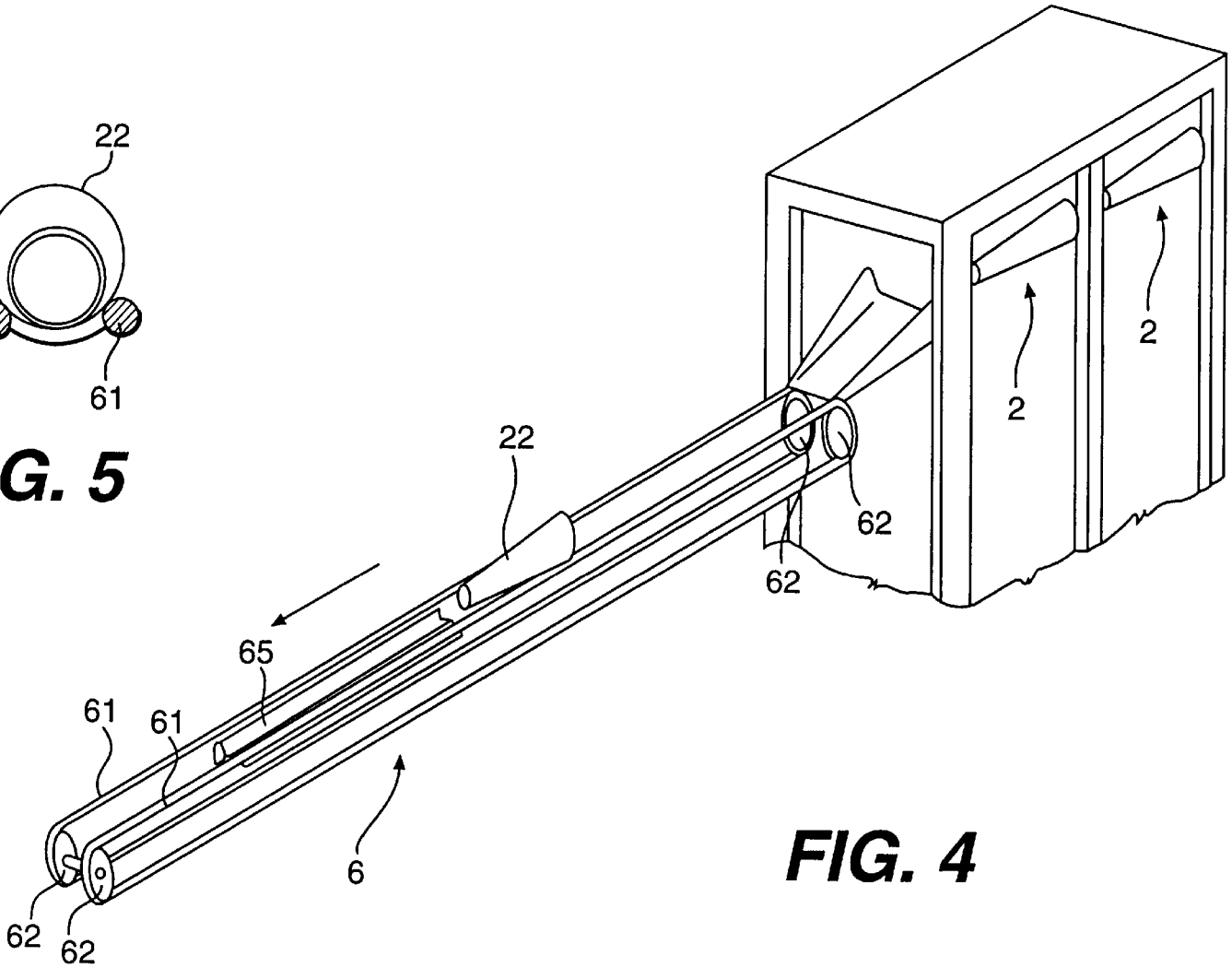
FIG. 4 is a view of the tube conveyer conveying a conical tube.
Figure 5:
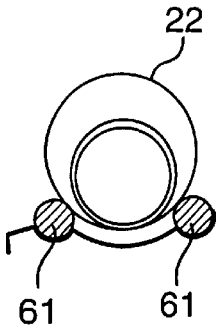
FIG. 5 is a cross section view of the conveyer shown in FIG. 4.
Figure 6:
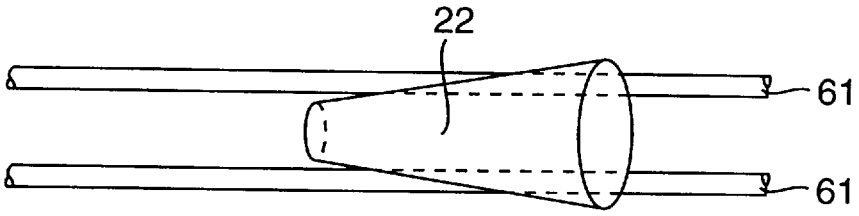
FIG. 6 is a plan view of the conical tube conveyed on the conveyer.
Figure 7:
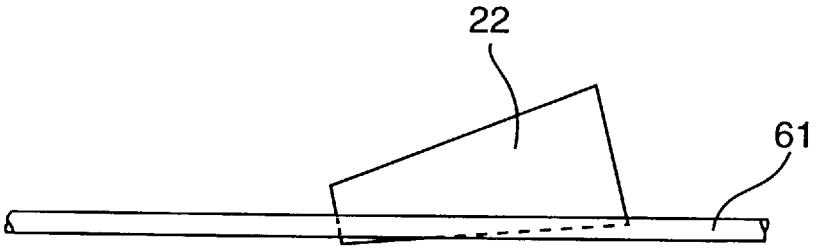
FIG. 7 is a front view of the conical tube conveyed on the conveyer.

The two endless belts 61, representing the active element of the conveyer 6, are seated at a predetermined distance from each other so that the lower part of the circumference of the tube 2 resting on the conveyer 6 lies below the upper tangent plane of the pair of the endless belts 61 of the conveyer 6 by which the tube 2 is stably seated on the conveyer 6, as shown in FIG. 3. The mutual distance between the endless belts 61 of the conveyer 6 must be less than the diameter of the cylindrical tube 21, and less than the average diameter of the conical tube 22, to be conveyed. The tube 2 is in contact with the pair of the endless belts 61 in two straight sections that, in the case of the conical tube 22, are longer than half the length of the conical tube 22 so that the conical tube 22 lies on the pair of the endless belts 61 stably and cannot change its position while being conveyed. The average diameter of the conical tube 22 is equal to one half of the sum of its small and large diameter. The average diameter of the cylindrical tube 21 is equal to its diameter.

The endless belts 61 of the conveyer 6 can have any cross section shape, for instance that of a rectangle, square, circle, oval, or trapezoid. In the shown example of embodiment, belts 61 of circular cross section are used.

The conveyer 6 can contain a larger number of endless belts 61 supporting the tube 2 during the transport in straight sections parallel with the direction of the motion of the conveyer 6. This embodiment can be used for cylindrical tubes 21, with the maximum distance between the endless belts 61 being inferior to the diameter of the cylindrical tube 21. In conical tubes 22, the use of a larger number of belts 61 is problematic, and their position would require modifications depending on varying conicity and dimensions of the conical tube 22.

Figure 8:
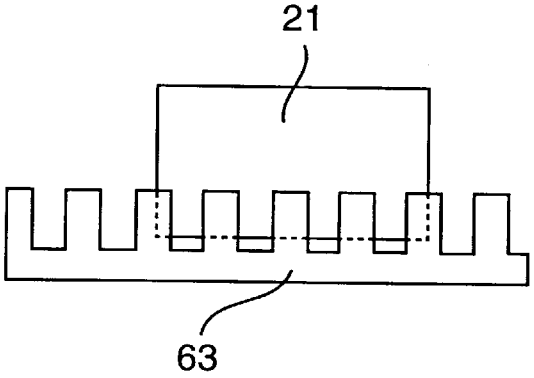
FIG. 8 is a front view of a conveyer consisting of an indented belt while conveying a cylindrical tube.
Figure 9:
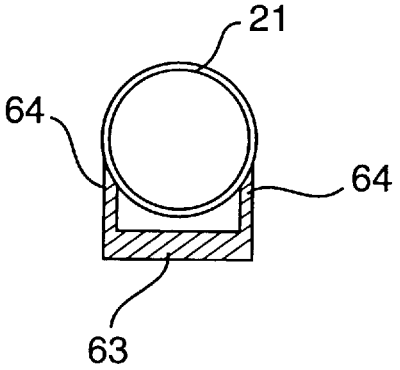
FIG. 9 is a cross section view of the conveyer with the tube shown in FIG. 8.

The conveyer also can be made as a single wide endless conveyer belt 63 on whose upper part rise upwards raised edges 64 which support the tube 2 in the same manner as the above mentioned pair of endless belts 61. The wide conveyer belt 63 is made of a sufficiently elastic material or as an indented belt with upwards oriented teeth whose edges make the raised edges 64. Thus, the tube is only supported at the tooth sections of the indented belts, and the straight sections in which the tube 2 is supported are interrupted by the gaps between the teeth of the indented belt as shown in FIGS. 8 and 9 for the cylindrical tube 21.

In the shown embodiment, the upper active strand of the pair of the endless belts 61 of the conveyer 6 is along the whole of its length (indicated only as partially extending in FIGS. 2 and 4 for clarity sake) over the operating units of the machine supported by a trough support 65 preventing the active strands of the pair of the endless belts 61 from sagging and at the same time serving as a support for the not shown gripping means of the attending device 4.

In other embodiments, in particular in short machines, the trough support 65 need not be used or it can be replaced for instance by support rollers or constructed in another way, depending on the kind of endless belt of the conveyer 6 used.

The distance between the endless belts 61 of the conveyer 6 can be made adjustable, and can be adjusted either on the driving and driven pulleys 62 or between these pulleys 62.

It should be apparent to those skilled in the art that various modifications and variations can be made in the present invention without departing from the scope and It is intended that the present invention cover such modifications and variations as come within the scope of the appended claims and their equivalents.

We claim:

1. A method for transporting cylindrical or conical tubes on a textile machine, said method comprising placing the tubes on a moving conveyor device such that the tube rests only on the moving conveyor device along two opposite and parallel lines of contact along the lengthwise circumference of the tubes, the parallel lines of contact also parallel to a conveying direction of the conveyor device, the moving conveyor device having spaced apart belt members with an upper surface contacting the tubes and a lower surface, said method further comprising supporting the moving conveyor device with a trough shaped support element disposed below the conveyor device and extending generally along the conveying path so that the trough-shaped support element supports the conveyor device along the conveying path while allowing a bottommost circumferential surface of the tube to extend below the conveying device, the trough shaped element having lateral sides which are shaped to the contour of the lower surfaces of the belt members and an intermediate arcuate portion which is spaced from the bottommost circumferential surface of the tube.

2. The method as in claim 1, further comprising placing the tubes on the conveyor device so that a plane tangent to a bottommost circumferential surface of the tube lies below a plane containing the lines of contact of the belt members.

3. A device for conveying textile tubes at a textile machine from a tube container to predetermined operating station of the textile machine, said device comprising a conveyor device configured to receive a textile tube from said container which is placed thereon in a longitudinal orientation and convey said textile tube in said longitudinal orientation along a conveying path, said conveyor device comprising spaced apart moving conveying members disposed so as to contact said textile tubes at two separate and parallel lines of contact longitudinally along said textile tube, said lines of contact lying in a plane which is above a plane tangent to a bottommost circumferential surface of said tube, and wherein said textile tubes rest only on said moving conveying members along said conveying path, said device further comprising a trough shaded support element disposed below said moving conveying members along said conveying path, said trough shaped support element having lateral sides which are shaped to a contour of a lower surface of said conveying members and an intermediate arcuate portion which is spaced from a bottommost circumferential surface of said textile tubes so that said textile tubes rest on said conveying members with said bottommost circumferential surface thereof extending below said conveying members.

4. The device as in claim 3, wherein said conveying members are spaced apart and parallel to each other along the entire length thereof a distance less than an average diameter of a tube conveyed thereby, said conveying members contacting and transporting textile tubes along an active strand thereof.

5. The device as in claim 4, wherein said conveyors have one of a circular or oval cross section.

6. The device as in claim 4, wherein said distance between said conveying members is adjustable.

* * * * *